United States Patent [19]

Wirth

[11] 4,239,501

[45] * Dec. 16, 1980

[54] METHOD FOR PRESERVING THE GRINDING CHARACTERISTICS OF A GRINDING TOOL

[76] Inventor: John C. J. Wirth, 98 Ponus Ave., Norwalk, Conn. 06850

[ * ] Notice: The portion of the term of this patent subsequent to Jun. 20, 1995, has been disclaimed.

[21] Appl. No.: 884,267

[22] Filed: Mar. 7, 1978

Related U.S. Application Data

[63] Continuation of Ser. No. 739,355, Nov. 5, 1976, Pat. No. 4,095,961, which is a continuation of Ser. No. 548,107, Feb. 12, 1975, abandoned, which is a continuation-in-part of Ser. No. 191,844, Oct. 26, 1971, abandoned, and Ser. No. 501,093, Aug. 27, 1974, abandoned, said Ser. No. 191,844, and Ser. No. 501,093, each is a continuation-in-part of Ser. No. 166,093, Jul. 26, 1971, Pat. No. 3,833,346.

[51] Int. Cl.[3] ..... B24B 17/00; C08G 51/12

[52] U.S. Cl. ..... 51/281 R; 51/295; 51/298; 51/308; 51/309; 83/22

[58] Field of Search ..... 51/295, 298, 307, 308, 51/309, 281 R; 83/22

[56] References Cited

U.S. PATENT DOCUMENTS

| | | | |
|---|---|---|---|
| 3,385,682 | 5/1968 | Lowen | 51/307 |
| 3,385,684 | 5/1968 | Voter | 51/298 |
| 3,528,789 | 9/1970 | Mathewson | 51/298 |
| 3,595,634 | 7/1971 | Sato | 51/298 |
| 3,607,161 | 9/1971 | Monick | 51/307 |
| 3,661,544 | 5/1972 | Whitaker | 51/298 |
| 3,833,346 | 9/1974 | Wirth | 51/307 |
| 4,007,020 | 2/1977 | Church et al. | 51/295 |

*Primary Examiner*—Donald J. Arnold
*Attorney, Agent, or Firm*—Barry Kramer

[57] ABSTRACT

A grinding and cutting process and articles employing an effective amount of a grinding aid, typical of which is sodium nitrite which, when applied to the abradant or cutting edge of a tool, accelerates the modification of a metal workpiece and prolongs the useful life of the tool. The grinding aids of this invention are compounds free of sulfur and/or halogen and having a melting point in the range of 70° F. to 1000° F., a decomposition temperature at least 100° F. above the melting temperature and a latent heat of melting greater than 10 cal/gm.

8 Claims, 9 Drawing Figures

METHOD FOR PRESERVING THE GRINDING CHARACTERISTICS OF A GRINDING TOOL

CROSS-REFERENCE TO RELATED APPLICATIONS

This is a continuation of application Ser. No. 739,355, filed Nov. 5, 1976, now U.S. Pat. No. 4,055,961, which in turn is a continuation of application Ser. No. 548,107 filed Feb. 12, 1975, now abandoned, which application is a continuation-in-part of my co-pending applications Ser. No. 191,844, filed Oct. 26, 1971 now abandoned; and Ser. No. 501,093, filed Aug. 27, 1974 now abandoned, and entitled "ABRADING AID", and "METAL GRINDING AND CUTTING ACCELERATOR CONTAINING SODIUM NITRITE", respectively, which in turn are continuation-in-part applications of Ser. No. 166,093, filed July 26, 1971, now U.S. Pat. No. 3,833,346, issued Sept. 3, 1974 and entitled "ABRADING AID CONTAINING PARAFFIN AND AN INHIBITOR."

BACKGROUND OF THE INVENTION

1. Field of the Invention

This invention relates to an aid for use in, and a process for, the machining of metals, and more particularly, to an aid which can be applied to cutting tools, drills, cut-off wheels, grinding wheels and coated abrasive products to accelerate the machining process.

2. Description of Prior Art

Abrasive products and cutting tools employed to remove metal stock generally fail, i.e., they lose cutting effectiveness, after varying periods of use, especially when they are employed to modify high temperature metal alloys. In the majority of cases involving high temperature alloys, one of the most prominent causes of failure resides in the fact that the freshly exposed or cut alloy surface is highly reactive and this "nascent" area is subject to the formation of a weld juncture which exerts an extremely high shear force against the abradant or cutting material. It is also quite clear that the welding becomes far more acute under conditions of high temperature. Although this inherent problem is encountered in all forms of grinding and cutting, it is particularly troublesome in the case of coated abrasives where the surface is not renewed as in grinding wheels and such. Since coated abrasives essentially rely on only a single layer of abrading particles, it has been found, to date that little can be done to improve their efficiency beyond a specific point.

It is also well-known that cutting tools, grinding wheels and coated abrasives become capped with a metal swarf, i.e., loaded. In addition to the problems of welding and loading, there exists what is known as "glazing", wherein the cutting edges become deformed by the extremely high temperatures to which the cutting points and edges of cutting tools, grinding wheels, abrasives and the like are exposed in grinding and cutting, causing plastic deformation of the cutting points and edges.

It appears that there is a direct inter-relationship between the foregoing factors and temperature. Factors which normally tend to elevate the temperature at the work surface (interface) also promote welding, chemical reactions, glazing generation of internal workpiece stresses, as well as burning of the workpiece surface, which adversely affect the metallurgical structure at the surface. These factors are present in all cutting techniques but they are substantially more severe in the super alloys due to their high temperature and low-thermal conductivity characteristics.

Attempts to externally improve grinding and cutting ability have included the application of grease sticks, oils and other lubricants to the workpiece surface during the grinding and/or cutting operation. Also, attempts have been made by various manufacturers to incorporate aids into abrasive belts and grinding wheels in a permanent fixed manner during fabrication.

These aids include solids, liquids and gases which serve generally to improve conditions within the restricted cutting or grinding area. Another common approach has been to incorporate within the metal to be machined quantities of sulfur, selenium and/or lead to provide improved machinability. A similar result can be attained by the use of grinding aids containing sulfur, halogens (e.g., fluorine, chlorine) and phosphorus. The most commonly used grinding aids are in the form of liquids and include water, soluble oils, mineral and fatty straight cutting oils, as well as those that are sulfurized and chlorinated. The latter, as stated above, may be effective for certain metals but are not entirely useful or desirable for certain super alloys and titanium due to chemical reactions between these chemicals and the metal surface being machined or ground. Greases and hard waxes are not effective except in reducing the loading of relatively soft metals such as aluminum, brass, etc. Other lubricants such as chlorinated and fluorinated hydrocarbons have been used to reduce heat generation in the area of the workpiece and grinding tool interface.

As a class, the presently employed aids are more or less toxic and their use and the surrounding environment must be strictly controlled so as to minimize any danger to the health of the operator. In the case of lead, bismuth, sulfur, mercury or halogen containing aids, gases generated during use can affect the workpiece and/or be toxic and care must be exercised in prolonged use with continual inspection and testing. In this regard, it should be observed that various specifications by the government and major aerospace manufacturers preclude the use of certain halogen materials in proximate relation with the workpiece as well as the operator.

The described aids have been used on standard materials with varying degrees of success but have been limited in the field of space-age super alloys to safeguard the surface integrity of the workpiece. Further, the enactment and enforcement of laws protecting the health of factory workers now requires warning labels when certain of these aids are included for example as a supersize coat on coated abrasives.

I have discovered that the problems mentioned with respect to the prior art grinding and cutting aids can be overcome and that any grinding or cutting process on any metal or other workpiece can be accelerated while also prolonging the useful life of the tool performing sad process by bringing the workpiece into relatively moving contact with a grinding or cutting edge in the presence of an effective amount of a grinding or cutting aid comprising at least 10% by weight of a solid compound free of sulfur and/or halogen and having a melting point in the range of 70° F. to 1000° F., a decomposition temperature at least 100° F. above the melting temperature and a latent heat of melting greater than 10 cal/gm. A typical compound having the above characteristics is sodium nitrite. Generally, inorganic compounds are preferred because of their lower cost of manufacture.

U.S. Pat. No. 3,595,634, issued to Sato discloses the employment of 3 to 10% by weight of sodium nitrite as one of the initial ingredients of his formulation and process for making grindstones. Sato teaches the use of a highly effective and superior anticorrosive chemical compound, namely, amine nitrite, which, Sato teaches, is the reaction product of amines (120 to 250% of the equivalent weight of the epoxide) with the 3–10% of sodium nitrite in presence of heat and pressure when mixed with epoxy. According to Sato, there is no sodium nitrite in the final product produced by his process.

U.S. Pat. No. 2,529,722, issued to Chester relates to a buffing and polishing composition for soft base metals which uses iron tailings as abrasive elements with alkali metals in the form of salts or complex oxides. To the foregoing, Chester adds a minute quantity of an electrolyte. Sodium nitrite is mentioned among other suitable materials as an electrolyte and only in minute proportions, namely, 1/16 to ¼% by weight as a rust inhibitor to prevent oxidation of the iron tailings in water. This amount would be insignificantly inadequate to perform the heat absorption function required of the aid of this invention.

U.S. Pat. No. 3,607,161, issued to Monick discloses a scouring composition which comprises a cationic surface-active compound and a water soluble abrasive. Monick lists in excess of 60 water-soluble salts which act as abrasives, one of which is sodium nitrite. Sodium nitrite in crystalline form is equated to an abrasive, and not taught to be an aid for some other abradant in lowering the grinding temperatures.

SUMMARY OF INVENTION

As indicated above, my invention consists in the discovery that grinding or cutting processing of metal workpieces can be accelerated while prolonging the useful life of the tool performing the process by bringing the workpiece into relatively moving contact with a grinding or cutting tool having an abradant or cutting edge in the presence of an effective amount of a grinding or cutting aid as described above and as typified by sodium nitrite ($NaNO_2$). For purposes of illustration, the principals of the present invention will be discussed below with particular reference to sodium nitrite.

It was discovered that sodium nitrite undergoes phase transitions when subjected to elevated temperatures. In such a phase transformation, the energy necessary to accomplish the transition is in the form of heat absorbed and is derived from surrounding objects.

Sodium nitrite, because of its excellent thermal properties in heat transfer, is used as the principal component in the formation of a grinding or cutting accelerator according to this invention. The quantity of sodium nitrite used is optimized to absorb, as much as possible, the frictional heat generated during the abrasive machining and/or cutting of metals and it was found that when sodium nitrite was applied, e.g., to a coated abrasive belt via a solid vehicle in the form of a cerate, the sensible surface temperature of the abraded metal can be reduced by 500° F. The reason for this is that a relatively large amount of heat generated by the abrading process is absorbed as the latent heat of melting of sodium nitrite.

The thermal properties of sodium nitrite were determined by differential thermal analysis. Examination of this data indicated the existence of peaks in specific heat with respect to temperature. There is an absorption of excess heat at 164° C. (327° F.), where a second order transition change occurs in the solid state. A second peak occurs at the melting point, namely 280° C. (536° F.). Further, sodium nitrite does not decompose at this temperature as taught in the technical literature, but will remain molten up to 675° F. (360° C.) before it decomposes.

In addition to the foregoing, the heat absorption of sodium nitrite was evaluated in terms of specific enthalpy vs. temperature. The second order solid transition at 164° C. provides a heat absorption from room temperature of approximately 42 cal/gr. At melting point, the latent heat of melting is about 55 cal/gr. For each gram of sodium nitrite applied to the surface of a cutting tool or an abrasive article such as a coated abrasive belt (to provide an interface between the abrasive grains and the metal workpiece), the sodium nitrite will absorb approximately 140 calories as its temperature is raised from room temperature to its peak molten temperature of 360° C. (675° F.).

Of basic and significant import is the fact that the solid state transition and the solid to liquid phase change of the sodium nitrite are reversible. This characteristic permits the continual use of the sodium nitrite aid on an abrading or cutting tool without the necessity of replenishment, since abrasion occurs at only one point along the travel of the tool, e.g., the belt or a grindstone, and during the rest of its travel while it is not in contact with the metal being abraded, allows sufficient exposure and time for the sodium nitrite to rephase, i.e., to change from liquid back to solid. Prior investigators in this field have been completely unaware of this primary knowledge and discovery and, therefore, have never contemplated the use of sodium nitrite in the area of high temperature grinding and/or cutting except possibly as an anticorrosion agent. However, as an anticorrosive or lubricating agent, the nitrite must be used in an aqueous solution which would turn to steam at 212° F. (100° C.), far below the melting point of sodium nitrite.

Due to its physical characteristics, sodium nitrite has the property and the ability of being an excellent heat-sink over a comparatively wide range of temperatures. This thermodynamic feature, plus a good high temperature (above 536° F.) lubricity and thermal conductivity of liquid sodium nitrite increases its effectiveness as an aid capable of hastening metal removal and extending the working life of the abrasive, since such high temperature phenomena, as the formation of metal swarfs, welds, and glazing are minimized.

To further illustrate my discovery, measurements were made of the surface temperatures in Waspaloy, the high-temperature alloy, which was abraded with and without an aid containing 50% by weight of sodium nitrite. The results indicate that the metal temperature was lowered by about 400° F. because the sodium nitrite absorbed a substantial amount of the frictional heat generated in the abrasion. The reasons for these findings can be rationalized by calculations from thermal data, making use of some simplifying concepts.

The heat transferred to the Waspaloy was calculated as follows:

$$\Delta \dot{h} = \int_{25^\circ\,C.}^{550^\circ\,C.} \dot{m}\,\overline{Cp}\,dt$$

where $\dot{m}=0.35$ g/min metal removal rate $\bar{C}p=0.12$ cal/gr/°C.—Average specific heat of aid $dt$=change in sensible temperature of metal in abrasion in °C.

$\Delta\dot{h}=(0.35)(0.12)(525)=23$ cal/min.

Under the same abrasion conditions, but with the use of the aid of this invention, it was found, by weighing, that 0.1 gr. of sodium nitrite was consumed during 1 minute of abrasion with a two foot length of belt. Accordingly, using 140 cal/gr. as the heat absorbed by sodium nitrite from FIG. 9, the calculated rate of heat absorbed by the sodium nitrite was $\Delta\dot{h}=0.1\ (140)=14$ cal/min. Thus, the sodium nitrite in this accelerator could account for dissipation of about 60% of the heat generated in the unaided belt. The fact that sodium nitrite is such an effective heat-sink accounts for the lower surface temperatures in the metals being cut or abraded. Furthermore, the temperature of the cutting edge of the abrading grain is kept cooler and because of this, the metal cutting efficiency continues. Further, as the grain is kept cooler, it can fracture along crystallographic cleavage planes, rather than plastically deform, and thereby present freshly renewed cutting edges to the abraded metal. Cutting efficiency and belt-life are thereby enhanced. However, if frictional heat is allowed to develop, the frictional heat results in plastic flow at the cutting point of the abradant grain, which blunts the grain, leading to loss of cutting efficiency and generation of more heat caused by the blunt grain pushing or plowing through the workpiece.

The basic principle of this invention resides in the application to the cutting point or edge of a tool, of an amount of a grinding aid, free of sulfur or halogen, which will change phase and melt without decomposition when exposed to an elevated temperature and by virtue of its high latent heat of melting, absorb excess thermal energy, thereby reducing temperatures of the cutting point or edge and the metal workpiece surface. The process is reversible since after passing the point of metal contact, the crystal, granule, or grain of grinding aid again cools and returns to its stable solid state.

Additional experimental investigations have revealed that good results can be attained with sodium nitrite when it is employed and uniformly distributed on the surface of the cutting tool in a matrix of a hard wax such as a paraffin wax or grease-like cerate and stearic acid, or in a soft wax such as microcrystalline waxes or slack wax, in an amount of between 10 to 70% by weight. "Soft" waxes are broadly defined to include tacky, sticky or gummy waxlike materials which provide a vehicle which independently will adhere to a rough moving surface, such as a coarse coated abrasive (grit size and larger than 50 grit) on a coated abrasive moving at a rate in the order of 5000 SFPM. Such materials are well-known.

It has been found desirable in fabricating the product of this invention, that the wax or grease cerate be first heated 20° F. above its melting point and, while in such melted state, heated grinding aid e.g., sodium nitrite in crystalline, granular or micropulverized form added thereto and uniformly dispersed therein. By preheating the aid to the same temperature as the wax prior to introduction, the temperature of the melt will not be prematurely lowered, thereby assuring proper uniform distribution of the aid throughout the wax matrix. The use of thickening or suspension agents to control the viscosity (e.g., CABOSIL—1% by weight) prevents the salt particles from settling while the mass is cooling.

The principles of the present invention can also be employed in ordinary machining processes such as drilling, milling and lathing by conducting the machining process in a manner such that the interface of the cutting edge and the workpiece immersed in a liquid or waxy vehicle containing at least 10% of the grinding aid. The vehicle may be a hard or soft wax as noted above, or a liquid such as water or preferably a natural or synthetic oily material such as a liquid hydrocarbon, or a Carbowax containing wetting and suspending agents to aid in the formation of a stable suspension of the aid. The effect of using sodium nitrite as a cutting aid is remarkable. For example, when 304 stainless steel is machined in the presence of normal cutting oils, the drilling pressure can be such that the metal is removed in the form of small burned chips and the effect of burning is obvious. However, at the same pressure, when an effective amount of sodium nitrite is added to the cutting oil, the metal is removed in the form of a cool, continuous, springy ribbon and the workpiece does not evidence any damage.

The grinding aid may be incorporated into and/or applied to the cutting or grinding edges in other vehicles and forms. It may be applied as a coating with or without a top coating to act as a vapor barrier to prevent pickup of water. It may be impregnated into porous grinding tools simply by soaking or pressure impregnating them in a nitrite molten or solvent solution which may contain a wetting agent to provide proper wetting and penetration. In addition, the aid can be incorporated directly into known grinding and/or cutting tools, as for example, during fabrication, e.g., in the size and/or make coat of a coated abrasive, and in the bonding resin of a bonded grinding wheel or cut off wheel. When applied as a coating, it can be admixed with a suspending agent and an inert liquid vehicle and can be applied by brush, doctor or roll coating, or even through an aerosol spray. It can also be applied as a 100% solid by using pressed or melted salts in a bar form or molten salt may itself be sprayed on the workpiece or the cutting tool or abrasive. For example, molten salts can be directed to the grinding interface when grinding or scarfing stainless steel billets with coarse grit resinoid wheels.

As noted above, the grinding aid can be incorporated into bonded or coated abrasive products by admixing it with the resins or adhesives which are used in formation of the product. Such materials may include glue, phenolics, urea formaldehydes, melamines, epoxies and the like. In the case of bonded resin products such as resinoid grinding wheels, the aid may be incorporated throughout the wheel or just in the radially external portions of the wheel. In the case of coated abrasive products, the aid may be used in the make coat and/or in the size coat, or in a super size coat. The resin-grinding aid mixtures may be joined by simply mixing the materials to obtain a uniform dispersion. The mixtures may then be admixed with or coated on abradant particles. A minimum amount of aid (i.e., from 10% to 60% based on the total weight of the coating) should be present in order to obtain the benefits of the present invention.

In the event it is desired to prevent intimate contact between the resin and aid as for example when the resin and the aid are reactive with each other, this can be easily accomplished by encapsulation of aid particles in a resinous or oily material using known encapsulation techniques, or by absorbing the nitrite into a porous mineral material such as vermiculite, perlite, alumina, koalin, etc. Alternatively, the pH of the resin may be modified to prevent reaction with the aid.

Accordingly, it is an object of the present invention to provide a relatively inexpensive and highly efficient aid for metal cutting and abrading processes.

Another object is to provide a metal cutting and abrading aid which may be externally applied to or fabricated directly in, the cutting and abrading tool and which will maintain a relatively lower temperature during operation, thereby preventing the undesirable results associated with excessively high temperatures.

Still another object is to provide an aid for the abrading of high temperature, high strength and low thermal conductivity metals and alloys which will hasten metal removal over an extended uniform period and prolong the useful life of the cutting and abrading tool used to carry out these processes.

Other objects and many of the attendant advantages of this invention will be more readily apparent from the following specification, claims and drawings.

DESCRIPTION OF THE PREFERRED EMBODIMENTS

Figure 1:
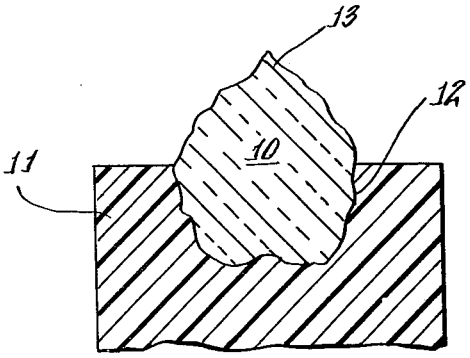
FIG. 1 is a sectional view of a typical cutting point or abrasive grain in a grinding wheel or on the surface of a coated abrasive.

Referring now to the drawings in detail wherein like numerals indicate like elements throughout the several views, the illustration of FIG. 1 shows a typical abrasive grain 10 firmly supported within what is designated as a holder 11 that may be in the form of resin, glue, glass, ceramic, metal or any suitable material to hold the grain during grinding. Holder 11 may be the size coat of a coated abrasive ("sandpaper") or the body of a grinding wheel. Although the grain extends substantially above the surface 12 of the holder, the top or cutting edge 13 performs the abrading function. This configuration is selected merely to represent a general type of cutting tool in the field of cutting and abrading and is employed for simple illustrative purposes.

In the process of abrading or grinding, the cutting tool, namely the abrasive grain 10, is continually fractured by the mechanical forces induced in the process. In this manner, as the sharp cutting edges of the grain are worn away by attrition by its contact with the metallic workpiece, new, sharp cutting surfaces are formed. This "renewing" only takes place under conditions wherein the grain will fracture. The grain will fracture (undergo attritious wear) under grinding conditions, provided, (1) it is in physical contact with the workpiece and (2) the temperature is below some critical value. The inclusion and use of a grinding fluid or solution in the process serves to maintain a continuous temperature below the critical fracture value, thus, in most instances, assuring the continual formation of cutting edges.

Figure 2:
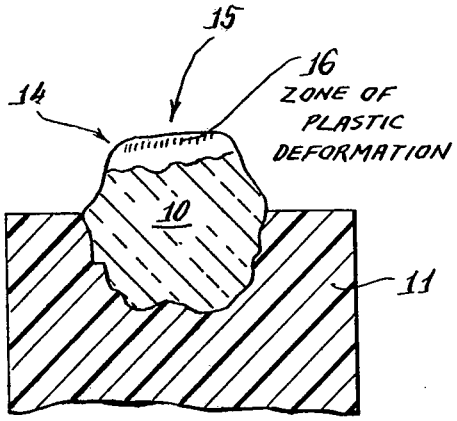
FIG. 2 is a sectional view showing the effect of plastic deformation caused by excess heat generated during the grinding operation on the cutting point of the grain.

On the other hand, as illustrated in FIG. 2, when the grain temperature is permitted to rise sufficiently high, the grain becomes "plastic" and its heated surface deforms. Under the grinding action in the direction 14 and the generated pressure along 15 between the grain and the metallic workpiece, the sharp cutting edges of the grain are blunted as at 16 and rounded out so that the grain instead of "chipping" away the metal is actually forced to "plow" therethrough. In so "plowing" the grain pushes a quantity of metal in front of it creating a furrow. This action, in turn, generates heat, raises the surface temperature and further plasticly deforms the grain, causing a substantial loss in abrading efficiency. If permitted to continue, the grinding effect will disappear and the workpiece surface will become discolored and scored while the grain abrading surface will assume a condition known as "glazed".

Figure 3:
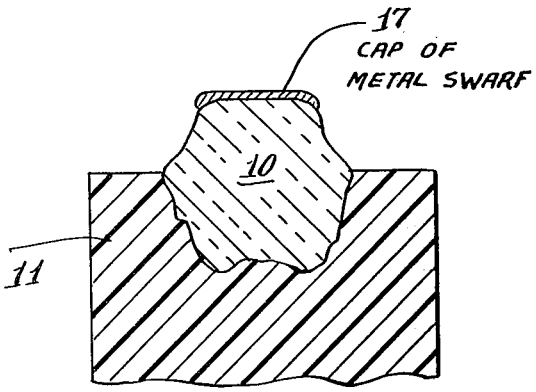
FIG. 3 is a section view showing the capping of the grain due to hot metal.

In addition to the foregoing, with certain metals, a metal swarf at elevated temperatures may melt and the portion so softened may deposit on the surface of the grains as shown in FIG. 3. The exposed surface of the grain will be capped with a metal swarf 17 to form an interface between the grain and the workpiece so as to preclude operational contact therebetween. Under these conditions no abrading action will occur even when the temperature is lowered.

Figure 4:
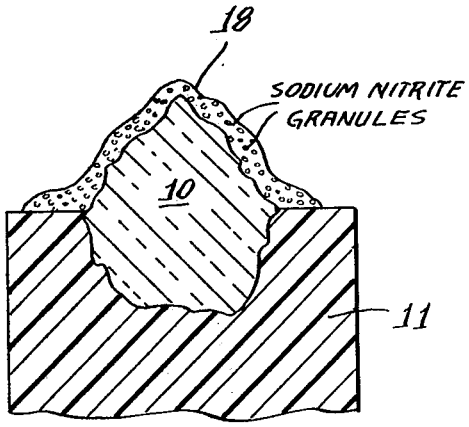
FIG. 4 is a sectional view of a grain overlayed with the accelerator of this invention.

By mixing or distributing uniformly an effective amount of a grinding aid of this invention, e.g., sodium nitrite, in a wax or grease matrix or cerate and daubing or applying the resultant material to the surface of the grains, they are provided with a uniform aid coating 18 as shown in FIG. 4 which will hasten metal removal from the surface of a workpiece.

Figure 5:
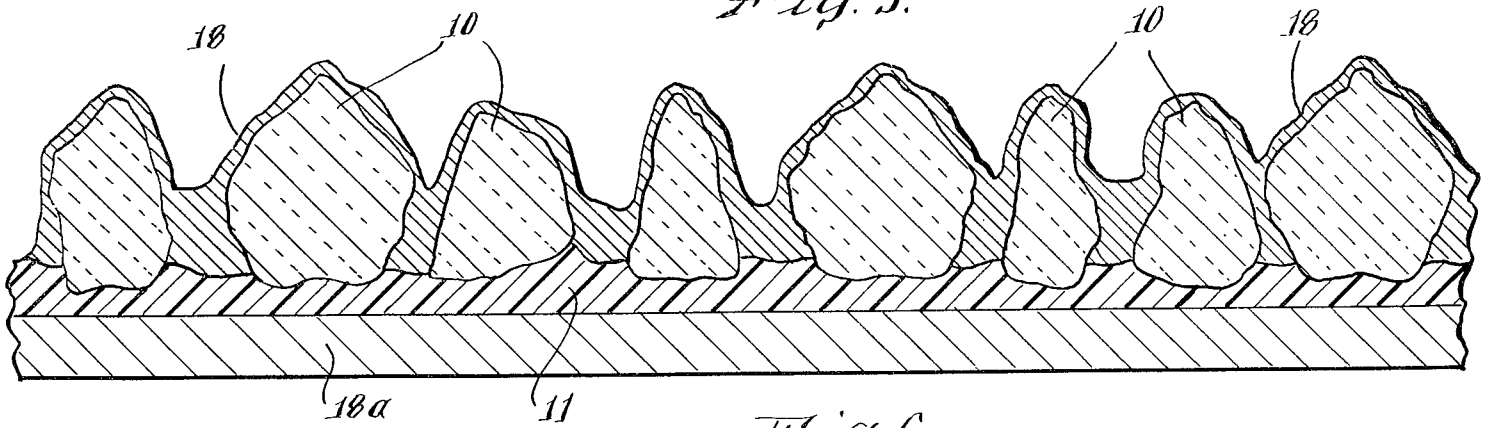
FIG. 5 is a sectional view of a coated abrasive prior to use, illustrating the fact that not all the grains are the same size or at the same height.
Figure 6:
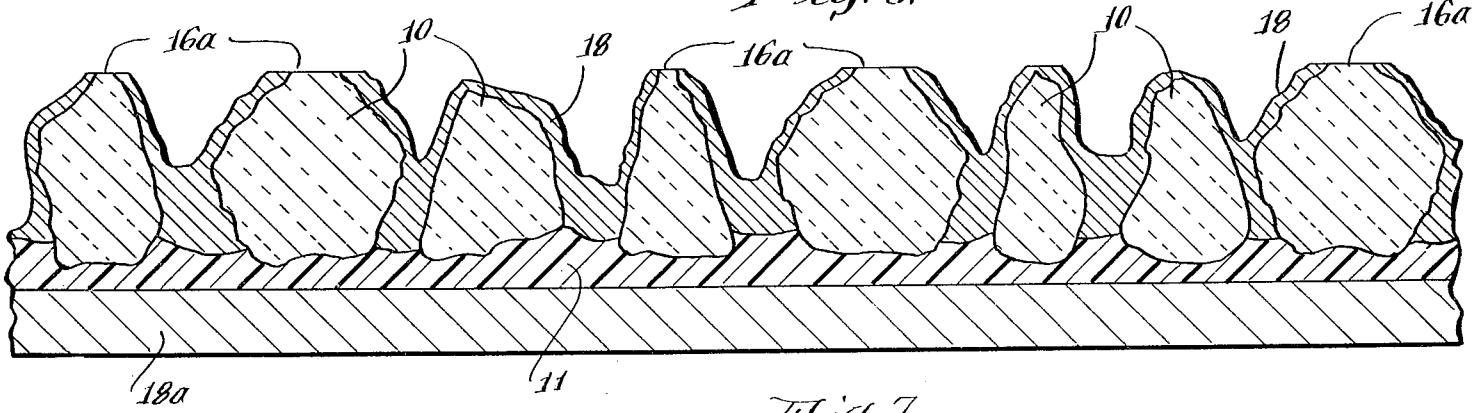
FIG. 6 is a sectional view of the coated abrasive after glazing has occurred, where the abrasive is no longer cutting but generating high temperatures in the workpiece and at the tips of the glazed abrasive grains.
Figure 7:
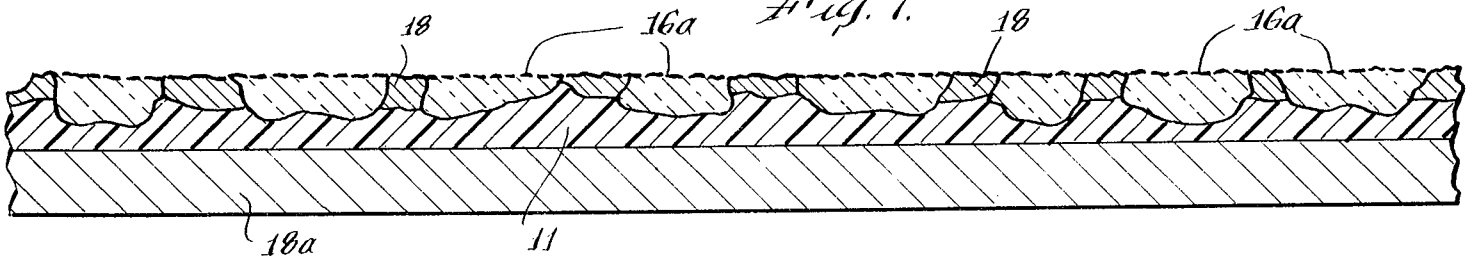
FIG. 7 is a sectional view of the coated abrasive when the grinding aid of this invention is employed illustrating the fact that the abrasive grains continuously renew their cutting surface and all the abrasive is used for grinding.

FIG. 5 illustrates the fact that the abrasive grains 10 on a coated abrasive having a backing 18*a*, a make coat 11 and a size coat 18, are not all the same shape or size nor the same height. FIG. 6 illustrates a coated abrasive after glazing occurs on surface 16 such as in the grinding of space-age materials. As will be noted, many abrasive grains such as low grains 10*a* do no cutting at all and whereas much of the abrasive remains, it is unable to perform its grinding function. FIG. 7 shows the effect of the grinding aid in allowing the abrasive grains to perform their normal grinding function by forming renewed cutting edges 16*a*. Interestingly, when the grinding aid is applied to a glazed abrasive as in FIG. 6, it will be restored to useful life and in the presence of the grinding aid will perform its grinding function and appear as in FIG. 7.

Figure 8:
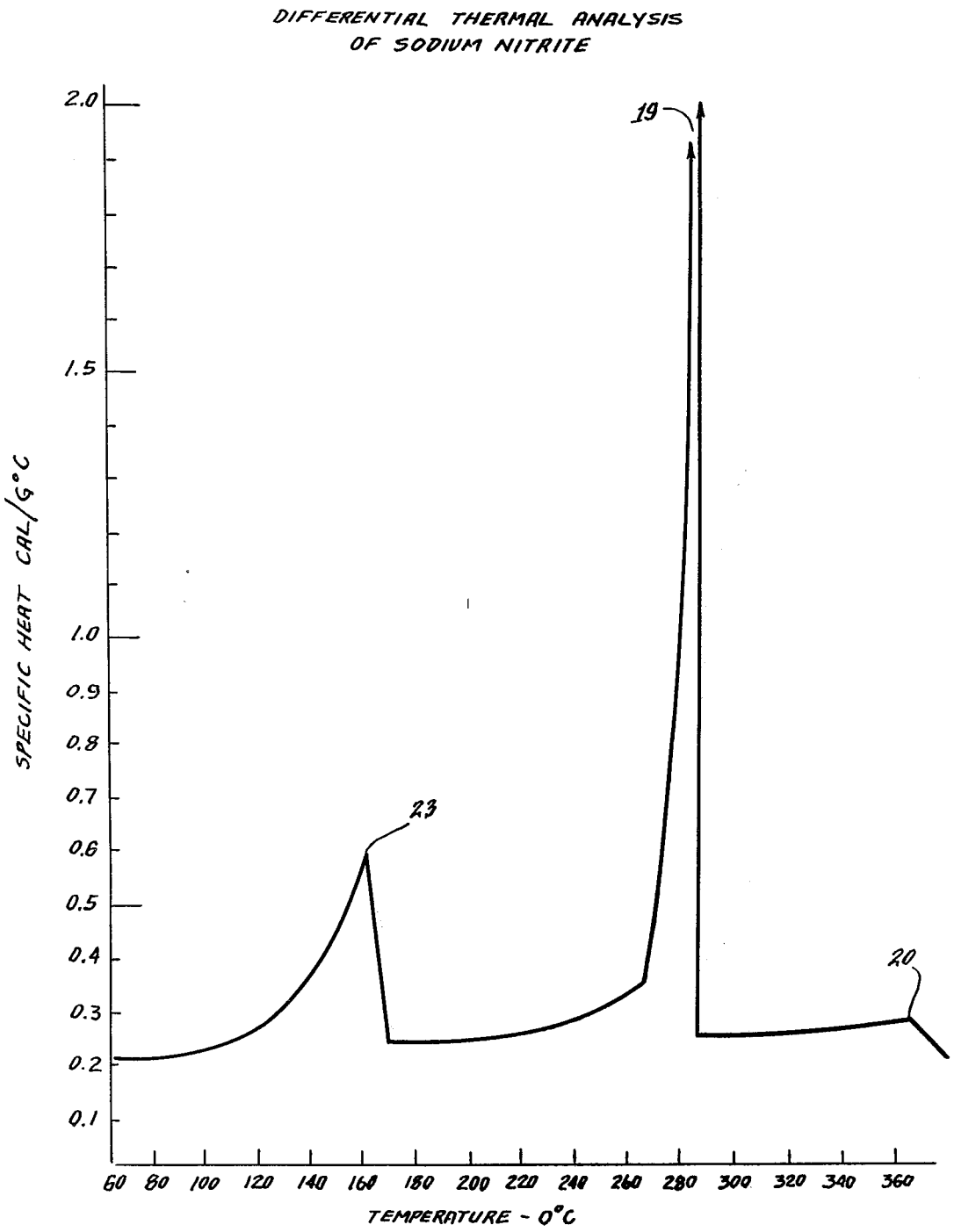
FIG. 8 is a graph of the differential thermal analysis of sodium nitrite.

The thermal properties of sodium nitrite were investigated by differential thermal analysis and the results are illustrated in FIG. 8. Examination of the plotted data indicates the existence of peaks in the specific heat with respect to temperature. There is an absorption of heat at 164° C. (327° F.) at the first peak 23, where a second order solid state transition change occurs. The second peak 19 occurs at the melting point, namely 280° C. (536° F.) which is at a low enough temperature to provide cooler surface temperatures, thereby insuring metallurgical surface integrity during abrasion while heat is being absorbed by the sodium nitrite. Further, sodium nitrite will not decompose at this temperature as taught in the technical literature, but will remain molten up to 675° F. (360° C.) before it decomposes.

Figure 9:
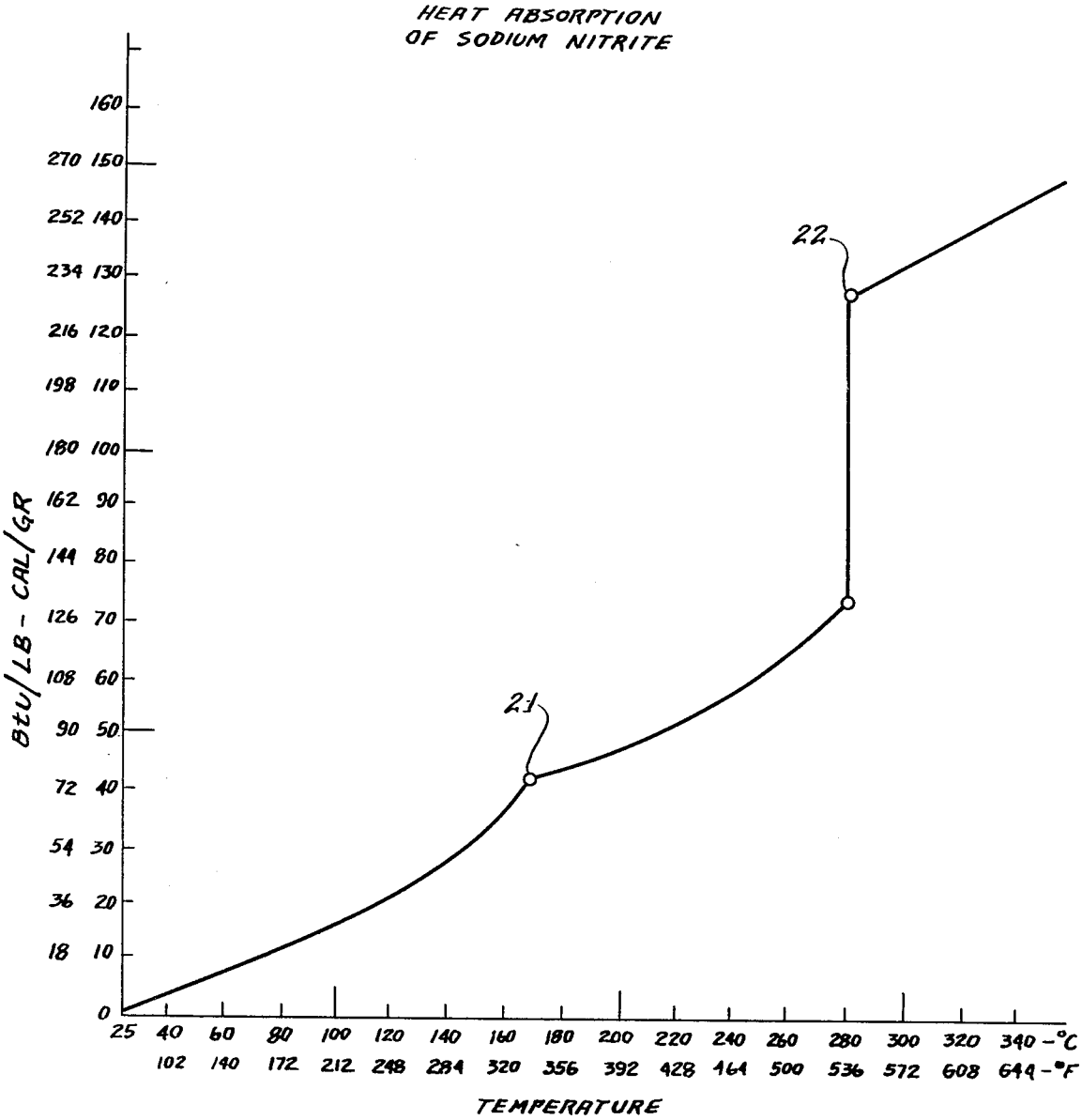
FIG. 9 is a graph showing the specific enthalpy change of sodium nitrite vs. temperature.

In addition to the foregoing, the heat absorption of sodium nitrite was evaluated in terms of specific enthalpy vs. temperature. The resultant plot thereof is shown in FIG. 9. The second order solid transition 21 occurs at approximately 164° C. with a heat absorption from room temperature of approximately 42 cal/gr. At the melting point 22, the total absorption from room temperature is about 130 cal/gr. with the latent heat of melting about 55 cal/grams.

From the foregoing data, it follows that thereoretically, for each gram of sodium nitrite applied to the surface of a cutting tool, such as an abrasive coated belt (to provide an interface between the abrasive grains and the metal workpiece), the sodium nitrite will absorb approximately 140 calories as its temperature is raised from room temperature to its peak molten temperature of 360° C. (675° F.).

Measurements were made of the surface temperatures in Waspaloy, a high-temperature alloy, which was abraded without and with the grinding accelerator containing 50% by weight of sodium nitrite. The results thereof, indicate that the metal temperature was lowered by about 400° F. because the sodium nitrite absorbed a substantial amount of the frictional heat generated in the abrasion.

The following are illustrative examples of the grinding aids made and used in accordance with the principles of the invention.

EXAMPLE I

A petroleum wax having a melting temperature of approximately 165° F. was first melted and held at a temperature of 20° F. above the melting point. To the molten wax a selected proportion of small dry granules of sodium nitrite was added. The sodium nitrite was at the temperature of the molten wax and uniformly distributed therein.

The resultant product was permitted to cool in a metal mold to provide a stick or bar-like configuration in order to facilitate handling and surface application. A number of such bars were fabricated, each with a different proportion by weight of sodium nitrite, including a control bar having no sodium nitrite. The specific bars fabricated included percentages of sodium nitrite from 10% to 70%.

Additional specimens were made with different carrier matrices or vehicles and each with the above-described percentages of sodium nitrite, e.g., Mobil Wax 412, 2305, tallow, lard, grease, stearic acid, beeswax, commercially available slack wax, belt dressings and grease sticks.

A typical, representative nickel-based super alloy referred to as WASPALOY was selected as the workpiece. It was in the form of a ¼ inch diameter rod. The abrasive selected as representative was a resin bonded 60 grit aluminum oxide coated abrasive belt which was mounted on a contact wheel whose speed was 3600 surface feet per minute. The workpiece was firmly mounted so as to provide an infeed pressure through dead weight loading of 16 pounds per square inch.

Initially, an untreated, as received, belt was evaluated by first abrading the workpiece to the extent that ⅜ inch thereof was removed and the time required to accomplish this was recorded. A second abrading run was then made removing an additional ⅜ inch of the rod, making a total of ¾ inch. Two independent passes were made to provide more accurate and meaningful results.

The same procedure was followed in evaluating all vehicles containing various percentages of sodium nitrite, including the vehicle without the nitrite (0%). Prior to each run or pass the surface of the 60 grit aluminum oxide resin bonded abrasive belt was uniformly coated by hand application of the specimen being evaluated and the time to remove a total of ¾ inch of the WASPALOY noted. After completion of these extensive experiments, it was found that the results were almost entirely (within experimental error) independent of the vehicle used. That is, the time required to abrade the workpiece for any one of the specimens, having the same percentage of sodium nitrite, was about the same. The following table was arrived at from the data recorded using Mobil 412 l paraffin as the vehicle carrying the sodium nitrite. The data was converted into percentage of time. saving attributed to the use of sodium nitrite as opposed to an untreated belt or a belt having thereon a vehicle containing no sodium nitrite. It was found that the average time required to remove ¾ inch of the workpiece (4.5 grams) for either the untreated belt or the belt coated with only the vehicle was 15.5 minutes.

TABLE I

| | |
|---|---|
| WORKPIECE | WASPALOY |
| BELT SPEED | 3600 SFPM |
| PRESSURE | 16 psi |
| ABRASIVE | 60 grit $ALO_x$ R.B. |
| VEHICLE | Mobil 412 paraffin |

| AID % $NaNO_2$ | TIME REQUIRED TO REMOVE ¾" – MINUTES (4.5 gr.) | RATE g/min. | % Increase |
|---|---|---|---|
| 0 | 15.5 | .25 | — |
| 10 | 13.2 | .34 | 36% |
| 20 | 11.2 | .40 | 60% |
| 30 | 9.0 | .50 | 100% |
| 40 | 6.7 | .66 | 164% |
| 50 | 5.0 | .90 | 260% |
| 60 | 4.3 | 1.04 | 316% |
| 70 | 3.7 | 1.21 | 384% |

It can be concluded from the foregoing that even relatively small amounts, on the order of 10%, begin to show some improvement in rate of metal removal through the use of sodium nitrite. Far greater improvement is evident for proportions above 20%, although it has been found that where abrasive powders and other materials (within the vehicle) are necessary for a particular finishing operation, small percentages of the aid, upwards of 10%, are useful.

The aid, as disclosed in this example, was applied to other metal alloys with the same results. Metal removal rates were first determined for a standard commercially available externally untreated belt and these were then compared to the rates of belts to which the aid was applied. The results where the workpiece was a titanium alloy (Ti-6Al-4V) and the abrasive was a 60 grit resin bond silicon carbide operated at a speed of 3600 SFM and at pressures of 4 and 8 psi are as follows.

The percentage increase in metal removal using a treated belt with an aid having as a vehicle 50 grams of paraffin, admixed with 50 grams of sodium nitrite ($NaNO_2$), operated at 4 and 8 psi respectively, over the untreated belt were 57% and 98%, respectively.

All the vehicles enumerated as being suitable possess one necessary physical characteristic, i.e., the ability to adhere to the surface of the fast moving abrasive surface. Although discernible differences in results were found among the various vehicles used, they all showed some improvement and therefore any vehicle capable of adhering to the belt surface by direct application and having a suitable melting point could be used, provided the aid can be dispersed therein. Such vehicles are well-known.

EXAMPLE 2

Attempts were made to prepare specimens wherein the sodium nitrite exceeded 70%, but the resulting bar lacked structural strength and, therefore, pure sodium nitrite was melted, and poured into a brass mold to form a bar. The bar was daubed or rubbed on to the abrasive surface of a moving belt and it was visually observed that only the smaller particles clung to the surface while the larger particles were readily dislodged by centrifical force. To assure retention, the surface of the belt with the nitrite thereon was coated or sprayed with shellac or krylon. Following the same test procedure, it was found that the percent time saving was only slightly better than that of the 70% sodium nitrite composition evaluated hereinbefore.

EXAMPLE 3

It has been found that molten sodium nitrite has a viscosity approaching that of water, and in addition, exhibits good wetting properties. To this end, a porous ceramic or vitrified grinding wheel heated to the melting temperature of sodium nitrite was entirely immersed into molten sodium nitrite, then removed and permitted to cool and dry. The grinding wheel was then used to grind tool steel on a surface grinder without the use of a grinding fluid. A similar grinding operation was performed with an 100% sodium nitrite bar applied to the surface. The treated surface and the immersed wheel exhibited in excess of a two-fold increase in grinding ratio, e.g., ratio of the weight of metal used to abrasive used.

Visual examination and weight measurements of the wheel before and after immersion revealed that the sodium nitrite had filled the interstices of the porous grinding wheel, thereby providing a continuous supply of sodium nitrite during the grinding operation.

EXAMPLE 4

Similar results as in Example 3 were obtained by immersing a preheated porous grinding wheel in a supersaturated aqueous solution of sodium nitrite at 265° F.

EXAMPLE 5

It has also been found that good results can be obtained by forming an aqueous and preferably saturated solution of sodium nitrite and wiping or brushing the liquid onto the abrading surface. However, under these conditions an aqueous or any other thin liquid will not readily adhere to a moving surface and therefore a thickening or thixotropic agent should be added to the solution. One such widely employed material is sold by Godfrey L. Cabot, Inc. under the mark CAB-O-SIL. This thixotropic agent is a colloidal silica prepared in a hot gaseous environment by a vapor-phase hydrolysis of a silicon compound. It should be noted that a wide variety of suitable thixotropic agents are readily available on the market and can be used in place of CAB-O-SIL, provided they do not create a health hazard and do not degrade or affect the workpiece. All that is necessary is that a sufficient quantity of the agent be added to the solution so that the resultant liquid admixture adheres to the moving abrading surface when it is applied thereto as by wiping or brushing the liquid on the surface to provide a thin coat. The mixture can be continually or intermittantly applied as desired. A typical example is as follows:

WORKPIECE—Greek Ascoloy RC-32, ⅝ inch rod
ABRADANT—60 grit aluminum oxide resin bond coated abrasive belt.
SPEED—3600 surface feet per minute
PRESSURE—7.3 pounds per square inch
AID—a saturated aqueous solution of sodium nitrite at 140° F. to which approximately 8% by weight of CAB-O-SIL was added.

An untreated belt was first employed to remove stock from the workpiece and the workpiece was weighed at equal time intervals to ascertain the total removed. The same procedure was followed for the same type of belt except a thin liquid coat of the aid was applied prior to abrasion. After 10 minutes 6.73 grams was removed by the "as received" or untreated belt while the belt to which the aid was initially applied removed 9.70 grams for the identical time interval, the percentage increase in value being 45%.

Although the percent of the thixotropic agent can be substantially varied, it is economically sound to employ the least proportion that will provide satisfactory results. Further, the thickened aid can be applied to the abrading tool and then permitted to dry or placed in an oven for that purpose.

EXAMPLE 6

Similar results are obtained when the solution described in Example 5 is dispensed from a manually operated spray can or bottle as well as when nitrite was directly incorporated into an aerosol system.

EXAMPLE 7

It has been found that sodium nitrite is hygroscopic, and although this does not severely inhibit the aid's characteristics, the resultant wetting of the tool or workpiece surface is undesirable. This problem can be overcome by providing an overlaying protective resinous film coating which embodies the particles of the aid and acts as a water vapor barrier.

Various coatings including phenolic, acetate, cellulose and urea resins can provide moisture barriers or shields which additionally serve to extend the shelf life and storage of the finished product. In the case of porous vitrified grinding wheels fabricated under high temperatures where the aid would be vaporized, the aid is applied by immersing the fabricated wheel in either molten salt or in a solution which may include therein any well-known wetting agent to provide increased absorption into the pores of the grinding wheel.

The sodium nitrite can be incorporated into the resin used in the size coat of a coated abrasive, with equally good results.

EXAMPLE 8

A suitable quantity (72% by weight) of abrasive grains, e.g., alumina, is wet with furfural in a mixing chamber. In a separate mixing vessel, 9.35% of phenol-formaldehyde resin, 16.5% of sodium nitrite, about 2.0% of lime and hexamethylene tetramine are blended to a homogeneous dry powder mass. The dry mixture is added slowly to the furfural wetted abrasive grains with mixing, until a uniform granular mix is obtained. The mixture is put into a mold, pressed and cured at approximately 350° F. in the mold.

The resultant grinding wheel has improved grinding properties as compared with a similar wheel made without sodium nitrate.

EXAMPLE 9

The use of an effective amount more than 10% sodium nitrite in other cutting aid fluids results in improved cutting speed, tool life and workpiece protection as shown in the following example:

About 40% by weight of finely pulverized sodium nitrite was added to a conventional cutting oil and used to lubricate a ½" drill in the drilling of 304 Stainless Steel about ½" thick. The conventional cutting oil was applied and the pressure increased to the point when the metal chips were blue and the drilled holes scored. The use of the cutting oil with the aid at the same pressure and speed did not discolor the metal nor score the holes. The metal removed with the aid showed no discoloration due to overheating.

EXAMPLE 10

It was demonstrated that $NaNO_2$ could be incorporated in a supersized coating on a regular coated abrasive belt, resulting in flexible coats which showed improved grinding characteristics.

The coat was made by mixing a phenolic resin and a neoprene rubber blend vehicle (1/1) with a quantity of finely-ground $NaNO_2$ and a solvent, so that the coating could be brushed on the belt uniformly. Upon drying, at 200° F. for 2 minutes, and at room temperature for one day, the concentration of $NaNO_2$ was 77.5% by weight of the dried supersized coat and 0.07 g/in.$^2$.

Tests in triplicate, under identical conditions were conducted with Waspaloy abraded on an as received belt, a supersized belt prepared as shown above, and a commercially available premium priced belt containing fluoride in the supersize coating. Comparisons made, after 6 minutes of abrasions, showed that the supersized coatings, containing $NaNO_2$ on regular belts resulted in a 140% increase in metal removed over the regular as-received belts. Furthermore, this supersized coating out-performed, by 45%, a commercially available premium-priced belt containing fluorides in its supersized coat.

EXAMPLE 11

The effect of particle size of $NaNO_2$, incorporated in a grinding aid externally applied to abrasive belts, was evaluated for two average sizes. In the free-flowing condition of the $NaNO_2$, normally obtained from commercial sources, the average particle size was about 250μ (microns), as determined by a sieving test. To make a grinding aid bar with a uniform suspension, a mixture of 54% salt, 45% molten microcrystalline wax, and 1% of thickening agent ("Cab-O-Sil") was prepared. This batch was cast into bars in a brass mold. Upon ball-milling the $NaNO_2$ so that it had an average particle size of about 100μ (microns) a solid bar grinding aid was made as above-described, except that it was not necessary to add a thickening agent. Due to the finer size of the particles, it was found that there was no preceptible settling in the molten wax and that this solid bar grinding aid showed improved adhesion onto a running belt of 60X Al-Ox R/B at 3600 SFM.

Comparative metal abrasion tests were conducted on Waspaloy under identical conditions. The improvement in metal removal in 5 minutes using the aid with the coarser particle size (250μ) of $NaNO_2$ was 36% over the as-received belt. As a result of using the aid with a finer particle size (100μ) of $NaNO_2$, the improvement was 49% over the as-received belt. The very fine sized particles in this test had about sixteen times greater surface area than the coarser ones and increased the efficiency of the grinding aid by removing 25% more metal during the time interval of this test.

EXAMPLE 12

The effectiveness of using a eutectic mixture of $KNO_3$ (55%) and $NaNO_2$ (45%) as the grinding aid was demonstrated by abrasion tests. Two different preparation methods were used and evaluated.

A simple mechanical mixture of the salts in the above proportion was ground in a mortar and pestle, and incorporated in a microcrystalline wax vehicle (55% salts and 45% vehicle and 1% Cab-O-Sil). The resultant aid was applied to the surface of an abrasive belt and used to grind Waspaloy. The improvement, after 10 minutes of testing for this aid over the as-received belt was 44%.

A eutectic mixture of $KNO_3$ (55%) and $NaNO_2$ (45%) was melted at about 300° F. then cast, cooled and ground in a mortar and pestle. When this was incorporated into a grinding aid bar, made as just described, it was evaluated in abrasion under the same test conditions. The improvement over the as-received belt was 84%.

Since this eutectic mixture melts at a temperature below that of lead used in lead cored grinding wheels it may be used to impregnate vitrified grinding wheels without rebalancing simply by immersing the grinding wheels into the eutectic solution at 300° F.

It was also found that the eutectic mixture of sodium nitrite (40%), potassium nitrate (53%) and sodium nitrate (7%) gave similar results, that this mixture remained in the liquid phase over a wide temperature range from about 290° F. to about 1100° F. and in the liquid phase had a high specific heat about 0.35 calories per gram per °C.

EXAMPLE 13

The effects of reducing the sensible temperature on the surface of a metal during abrasion were measured experimentally. Sensible temperature is defined as the temperature measured with 30 gauge chromel-alumel thermocouples imbedded at a constant location in a metal at the time the abrasive grains cut through the couple. These were recorded on a L&N Azor instrument with a chart speed of 6'/minute and indicating the seeback emf (converted by calibration to °F.). In each case, the thermocouple was positioned in the middle of a ¼" round Waspaloy at 0.25" from the surface at the start of abrasion.

The surface conditions of the belt were I—as-received condition; II—heated with a grinding aid stick having 55% $NaNO_2$; III—a dried supersized coating painted on the belt which coating contained 77.5% $NaNO_2$ or 0.079 g/in.$^2$ $NaNO_2$; and IV—heated with a soft stick wax commercially sold as a grinding aid.

The results of these tests are given in the following Table showing the significant decreases in sensible temperatures when using the grinding aids of this invention. For example, it was possible to show a decrease in sensible temperature by about 600° F., during this test when the most concentrated amount of $NaNO_2$ was existent on the belt surface.

TABLE

MEASUREMENTS OF SENSIBLE SURFACE TEMPERATURES REACHED IN ABRADING WASPALOY

| Code | Belt Condition | Sensible Temperature of | Time To Remove 2.259g | Average Metal Removal Rate-g/min. | % Improvement in Metal Removal |
|---|---|---|---|---|---|
| I | As-received Belt | 1860 | 2.10 | 1.07 | — |
| II | Grinding Aid Stick (55% $NaNO_2$) | 1300 | .95 | 2.35 | 120% |
| III | Supersized Coating on Belt (77.5% $NaNO_2$ – .07 g/in.$^2$ $NaNO_2$) | 1200 | .94 | 2.40 | 124% |
| IV | Commercial Stick-Wax | 1500 | 2.45 | .91 | –15% |

EXAMPLE 14

When coatings of the aid made with Mobil Wax 412 and other paraffins, tallows, etc., were uniformly coated on 60 grit aluminum oxide coated abrasive, the same rate of metal removal was noted; however, it was observed that the aid made with Mobil 412 paraffin, etc. was not as relatively effective on the coarser grits such as 36 grit aluminum oxide. Quantitative studies disclosed that the reason was that the Mobil Wax 412 paraffin was too hard and lacked sufficient adhesion and the large grains of the coarser grit belts chopped away at the relatively hard and brittle matrix and little of the aid attached itself to the 36 grit belt.

The following example shows the percentage of material applied, which actually adhered to the 36 grit aluminum oxide belt with increasing nitrite content:

| Example: | |
|---|---|
| Belt: | 36 grit aluminum oxide belt 4" × 132" |
| Speed: | 3600 S.F.P.M. |
| Aid: | 50% Sodium Nitrite, 49% Mobil 412 Paraffin, 1% CAB-O-SIL in the form of a $\frac{5}{8}$" × $1\frac{5}{8}$" bar applied by an air cylinder with 3 psi pressure for 10 seconds. |

| Percent by Weight $NaNO_2$ | Percent by Weight of Bar adhering to Abrasive |
|---|---|
| 10 | 55 |
| 20 | 57 |
| 30 | 24 |
| 40 | 28 |
| 50 | 20 |
| 60 | 19 |

Whereas the data reported in the immediately preceding Table indicated substantially high metal removal rates with increased percentages of nitrite, this example shows that less material adheres to the abrasive as the percentage of nitrite increases making the use of the aid very costly and impractical on the coarser grits.

When Mobil 2305 microcrystalline wax, a tacky material, was substituted for Mobil 411, the percentage of adhesion increased twofold. Other soft waxy materials were used such as slack wax with similar results. However, some of these other materials have limited application because they contain sulphur, which can be poisonous to certain spaceage alloys, or insoluble gums and resins which are difficult to remove from the metal after grinding and interfere with welding, electroplating, etc.

One of the more satisfactory matrix materials was refined petrolatum modified wax paraffin having high adhesion to coated abrasive surfaces, minimal sulphur, gum and resin content and ready solubility at low temperature in commercially available solvent type metal cleaners.

The aid suitable for application to coarse grit abrasive was applied in the grinding of numerous metals with uniformly favorable results on a variety of coarse and fine grit abrasive belting.

Numerous tests conducted with sodium nitrate showed results similar to, but not quite as favorable as, sodium nitrite. Further tests with potassium nitrate also proved effective, but not as favorable as sodium nitrite.

Tests conducted with mixtures of granules of these compounds produced favorable results with grinding time less than that for potassium nitrate but longer than sodium nitrite.

It was found that a mixture of 45% sodium nitrite with 55% potassium nitrate when melted together form a eutectic having a melting point of about 290° F.

The cooled eutectic mixture was ground and its performance as an aid closely approximates that of sodium nitrite.

The lower melting point eutectic is particularly useful to impregnate porous vitrified grinding wheels at temperatures above 290° F. The lowered temperature of the eutectic compound compared with 536° F. for the sodium nitrite, permits the impregnation of manufactured grinding wheels equipped with lead cores without melting such cores.

The use of low melting point eutectics permits this invention to be utilized by industrial distributors of grinding wheels as a service to their customer and, also, by large industrial consumers of vitrified grinding wheels who may wish to impregnate vitrified grinding wheels on their premises without the need for manufacturing new cores, balancing, etc.

Since the salts are hydroscopic and will pick up atmospheric moisture, a spray of varnish Krylon or similar barrier coating keeps treated wheels dry.

Investigations were conducted using other chemical compounds free of halogens and sulphur having melting points above a temperature of 70° F. and below 1,000° F. and temperatures of dissociation at least 100° F. higher than the melting temperature, and relatively high latent heat of melting in excess of 10 cal/gram, with notable increase in metal removal rates and substantial lowering of the temperature of the workpiece as follows:

Waspaloy rod (⅜") weighing 2.65 g. was ground on a 60 grit belting and the cutting time was measured. All the aid samples were prepared using a microcrystalline wax having 1% Cab-O-Sil and 45% of the salt. The grinding time and rate of metal removal are given in the following table:

| AID | TIME (min.) | RATE (g./min.) | % INCREASE |
|---|---|---|---|
| As received | 3.86 | .68 | — |
| $K_2CrO_4$ | 1.53 | 1.73 | 154 |
| $LiNO_3$ | 2.43 | 1.1 | 61 |
| $NaNO_3$ | 1.4 | 1.9 | 179 |
| $KNO_3$ | 1.62 | 1.64 | 141 |
| $NaNO_2$* | 1.2 | 2.2 | 223 |

*For comparison

From these results and a review of the physical properties of other chemical compounds it was concluded that other chemicals or mixtures might be substituted for, or mixed with, sodium nitrite as a grinding and cutting aid provided they are neither explosive nor inflammable under conditions of use and they meet the definition in the preceding paragraph as to high latent heat of melting and relatively low melting temperature (70° F. to 1000° F.) with decomposition taking place at least 100° F. above the melting point to permit the molten compound to function as a high temperature coolant and lubricant continuously as it is heated and cooled in the grinding process.

Experiments were also conducted to determine the effect of the particle size of the chemical compounds used in the aid.

The differences due to particle size are of relatively minor significance, however, since the presence of effective amounts of the aid produced very substantial improvement in grinding efficiency in the order of 50% to 350%. The improvements due to the control of the particle size are in the order of 10 to 25% of the total improvement.

What is claimed is:

1. Method for preserving the cutting or grinding characteristics of a cutting or grinding tool while maintaining the surface integrity of a metal workpiece at an accelerated rate of cutting or grinding comprising;

effecting contact and relative motion between said workpiece and a cutting or grinding edge of a cutting or grinding tool;

applying to the interface between the edge of said cutting or grinding tool and said workpiece, an effective amount of at least one inorganic compound which will undergo melting without decomposition and which is neither explosive nor flammable upon exposure to the frictional heat generated at said interface during periods of such contact and relative motion, said compound being free of sulfur and/or halogen, stable under conditions of use, and having a reversible solid—liquid phase transition in the range of 70° F. to 1000° F., a decomposition temperature of at least 100° F. above the melting temperature and a latent heat of melting greater than 10 cal/gm.;

whereby, said compound, upon exposure to said frictional heat, undergoes melting and reduces the surface temperature generated at said interface by the heat absorption due to heating said compound to the melting point, the latent heat of melting of said compound and the additional heat absorption of the molten compound, while simultaneously forming a lubricating liquid film at said interface.

2. Method as defined in claim 1 wherein said compound is applied in a wax matrix, in an amount between about 10 to 70% by weight.

3. Method as defined in claim 1 wherein said compound is applied in a liquid vehicle, in an amount between about 10 to 70% by weight.

4. Method as defined in claim 1 wherein said compound is applied in a grease vehicle in an amount between about 10 to 70% by weight.

5. Method as defined in claim 1 wherein said compound is applied by impregnating same into a porous vitrified grinding tool.

6. Method as defined in claim 1 wherein said compound is applied by incorporating same in the size, super size and/or make coat of a coated abrasive.

7. Method as defined in claim 1 wherein said compound is applied by incorporating same in the bonding resin of a bonded grinding wheel or cut off wheel.

8. Method as defined in claim 1 wherein said compound is applied per se, in either solid or molten form.

* * * * *